US009435554B2

(12) United States Patent
Cothren et al.

(10) Patent No.: US 9,435,554 B2
(45) Date of Patent: Sep. 6, 2016

(54) OUTDOOR HEATING OR COOLING SEATING SYSTEM

(75) Inventors: Brian Cothren, Fleming Island, FL (US); William Quillen, Sr., Jacksonville, FL (US)

(73) Assignee: ATHLETIC RECOVERY ZONE, LLC, Jacksonville, FL (US)

( * ) Notice: Subject to any disclaimer, the term of this patent is extended or adjusted under 35 U.S.C. 154(b) by 279 days.

(21) Appl. No.: 13/398,962

(22) Filed: Feb. 17, 2012

(65) Prior Publication Data

US 2013/0213070 A1 Aug. 22, 2013

(51) Int. Cl.

| | |
|---|---|
| ***F25D 11/00*** | (2006.01) |
| ***F25D 23/00*** | (2006.01) |
| ***F25D 17/06*** | (2006.01) |
| ***F24F 5/00*** | (2006.01) |
| ***F24F 9/00*** | (2006.01) |

(52) U.S. Cl.

CPC ..... *F24F 5/0096* (2013.01); *F24F 9/00* (2013.01); *F24F 2009/007* (2013.01); *F24F 2221/18* (2013.01)

(58) Field of Classification Search

CPC ..... F24F 2221/10; F24F 2221/12; F24F 2221/125; F24F 2221/18; F24F 5/0096; F24F 11/03; F25D 11/03; F25D 17/06; F25D 17/08

USPC ..... 62/261, 263, 426–428, 237, 411, 448

See application file for complete search history.

(56) References Cited

U.S. PATENT DOCUMENTS

| | | | | |
|---|---|---|---|---|
| 2,782,834 | A * | 2/1957 | Vigo | 297/180.14 |
| 3,097,505 | A * | 7/1963 | Smith | 62/261 |
| 3,745,305 | A | 7/1973 | Reed et al. | |
| 3,818,892 | A | 6/1974 | Von Kohorn | |
| 3,858,643 | A * | 1/1975 | Reed | A61F 7/02 165/47 |
| 3,875,996 | A | 4/1975 | Von Kohorn et al. | |
| 3,948,246 | A | 4/1976 | Jenkins | |
| 4,134,615 | A | 1/1979 | Jenkins | |
| 4,307,701 | A | 12/1981 | Balon et al. | |
| 4,989,600 | A * | 2/1991 | Collier | A47C 1/14 5/421 |
| 5,062,424 | A * | 11/1991 | Hooker | 128/897 |
| 5,450,894 | A * | 9/1995 | Inoue et al. | 165/43 |
| 5,459,887 | A * | 10/1995 | Roman et al. | 4/541.4 |
| 5,596,836 | A | 1/1997 | Benson | |
| 6,435,608 | B1 | 8/2002 | Floyd, Jr. | |
| 6,580,060 | B1 | 6/2003 | Inman et al. | |
| 6,776,453 | B1 | 8/2004 | Floyd, Jr. | |
| 6,863,342 | B2 | 3/2005 | Floyd, Jr. | |
| 7,234,318 | B2 | 6/2007 | Grisler | |
| 2002/0175541 | A1 * | 11/2002 | Floyd, Jr. | A47C 7/744 297/180.12 |
| 2005/0250436 | A1 | 11/2005 | Nilsson | |
| 2007/0193279 | A1 * | 8/2007 | Yoneno et al. | 62/3.3 |
| 2011/0100592 | A1 | 5/2011 | Johnson | |
| 2011/0163580 | A1 * | 7/2011 | Lucas | B60N 2/5635 297/217.1 |

* cited by examiner

*Primary Examiner* — Len Tran

*Assistant Examiner* — Kirstin Oswald

(74) *Attorney, Agent, or Firm* — Thomas C. Saitta

(57) ABSTRACT

A cooling or heating seating system creating an open, unbounded, temperature-controlled zone for personnel, said seating system having HVAC equipment for producing and delivering cooled or heated air, a first air outlet disposed in a deck member, a second air outlet disposed in a seat back member, and a first air return disposed in the seat back member between a seat member and a seat back rest. The system may be transportable.

17 Claims, 3 Drawing Sheets

OUTDOOR HEATING OR COOLING SEATING SYSTEM

BACKGROUND OF THE INVENTION

This invention relates generally to the field of devices used to provide localized cooling or heating in an outdoor setting, and more particularly to such devices capable of cooling or heating personnel, such as athletes standing or sitting on the sidelines of sporting events, firefighters at the scene of a fire, workers in high or low temperature environments, participants in long running races, etc., and more particularly relates to such devices that provide cool or warm air in controlled zone accessible by the personnel.

Sporting events such as football, soccer, tract, etc., occurring outdoors are subject to weather conditions of extreme high or low temperatures. The athletes in these events, particularly when standing or sitting on the sidelines during a contest or after participation, can become overheated or badly chilled. Likewise, workers toiling outdoors under extreme temperature conditions, in particular when heavy safety or protective gear must be worn, are susceptible to overheating or hyperthermia.

It is an object of this invention to provide a system for supplying cooled or heated air to a localized outdoor zone in a controlled manner such that personnel may enter the temperature-controlled zone to be warmed or cooled, wherein the temperature-controlled zone is not a fully enclosed environment. It is another object to provide such a system that is transportable such that the system can be brought to any location where a controlled heating or cooling zone is required.

SUMMARY OF THE INVENTION

The outdoor heating and cooling seating system is generally comprises a bench device having a seat member, a seat back member, and a deck member, and a cabinet. The air flow of the system is controlled by an apparatus comprising a first air outlet, a second air outlet, a first air intake, and a high volume air conditioning (HVAC) means for conditioning air by producing heating or cooling temperature charge to air.

In a general embodiment of the system, and the first air outlet is positioned on the deck member, and the second air outlet is disposed above the back rest. The first air intake is located in the seat back between the back rest and the seat member. The HVAC means is connected to the first air outlet and the second air outlet by one or more air delivery conduits. Optionally, and the first air intake can be connected to the HVAC means by an air return conduit.

The HVAC means forces conditioned air through the air delivery conduits to the first air outlet and the second air outlet, where the conditioned air is expelled by the seating system to create a temperature-controlled zone. Once the user enters the zone, heat is exchanged between the user and the charged air, depleting the temperature charge of the air. A first portion of air having a depleted charge is then retrieved from the temperature-controlled zone via the first air intake and passed through the air return conduit and returned to the intake of the HVAC means. This first portion of air is then reconditioned by the HVAC means and once again delivered to the first air outlet and the second air outlet via the air delivery conduits.

In another embodiment, the seating system further comprises a second air intake disposed in the bench device below the seat member and above the deck member, and operably connected to the air return conduits. The second air intake further comprises a damper that is manipulated to control the flow of air through the second air intake. When the damper opens, air reenters the system via the second air intake, whereby the air is returned to the HVAC means via the return conduits.

In another embodiment of the seating system, the bench member further comprises transportation means for transporting the system, such as a motorized vehicle or wheeled trailer, such that the system can be taken to any outdoor location where a temperature-controlled zone is desired.

DETAILED DESCRIPTION

Referring to the Figures, various embodiments of an exemplary outdoor heating or cooling seating system, and components thereof, are described and shown. Generally, a seating system according to principles of the invention provides a first air intake configured to draw a portion of air from the temperature-controlled zone and return this portion of air to the HVAC heating or cooling device. The embodiments disclosed herein are meant for illustration and not limitation of the system. An ordinary practitioner will understand that it is possible to create other variations of the following embodiments without undue experimentation. For the purposes of illustration and not limitation, the following discussion is presented in the context of a sideline bench used by a professional sports team, such as a professional football team. However, an ordinary practitioner will understand that the seating system described herein could be adapted for other uses without undue experimentation, such as for firefighters near an emergency location, construction workers in harsh construction environments, or other such scenarios.

The heating or cooling seating system is capable of delivering heated or cooled air into a substantially open or unbounded zone such that personnel standing or sitting in the zone are cooled or warmed as needed, the defined temperature-controlled zone having a temperature lower than the ambient in hot weather and a temperature higher than the ambient in cold weather. The unbounded zone is not physically enclosed by walls, tarps, or the like. In another general embodiment, the seating system comprises a wheeled, transportable system capable of delivering heated or cooled air into a defined, substantially open unbounded zone in a variety of locations or operation sites. This transportable system allows for ease of relocating the seating system, such as to reconfigure the sideline bench area for specific athletic applications, such as reconfiguring a football sideline for subsequent use by a soccer team.

Figure 1:
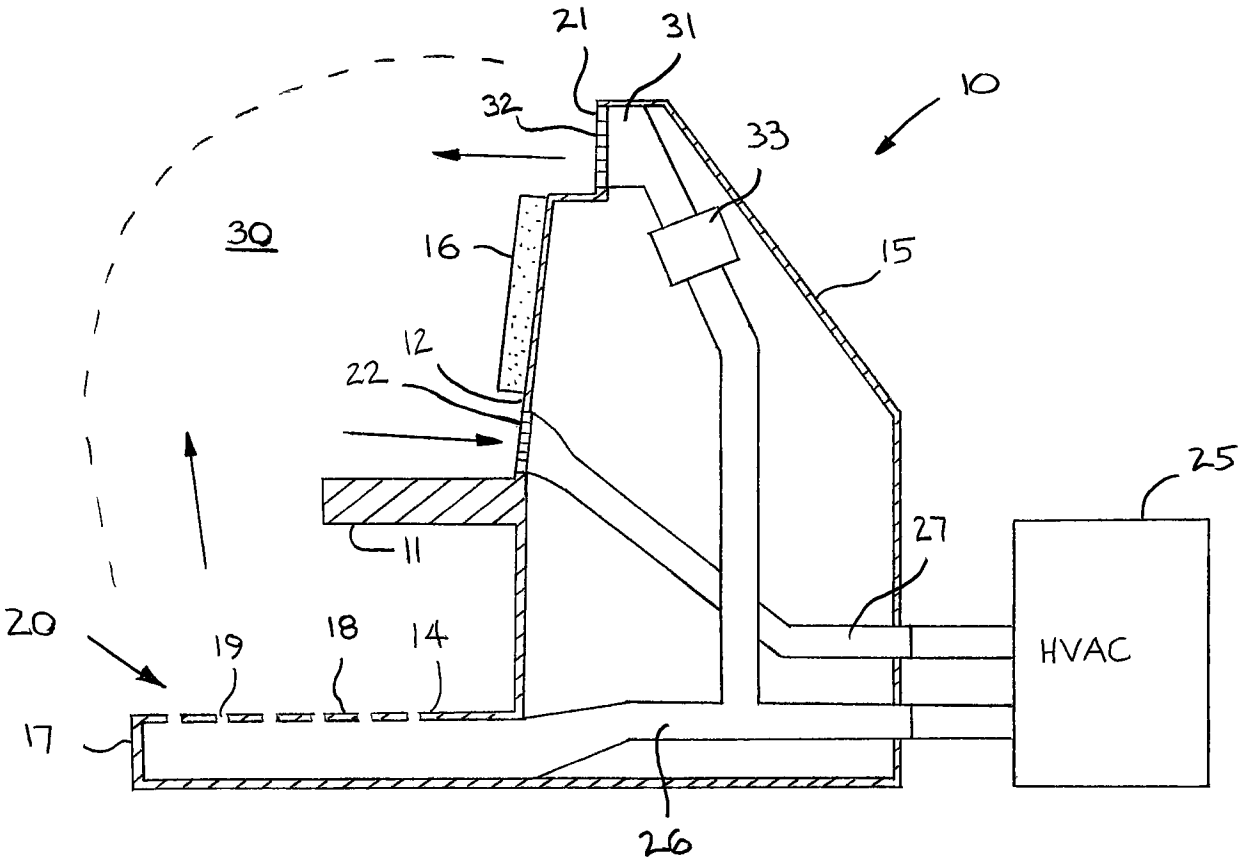
FIG. 1 is a cross section view of a basic embodiment of the seating system.
Figure 2:
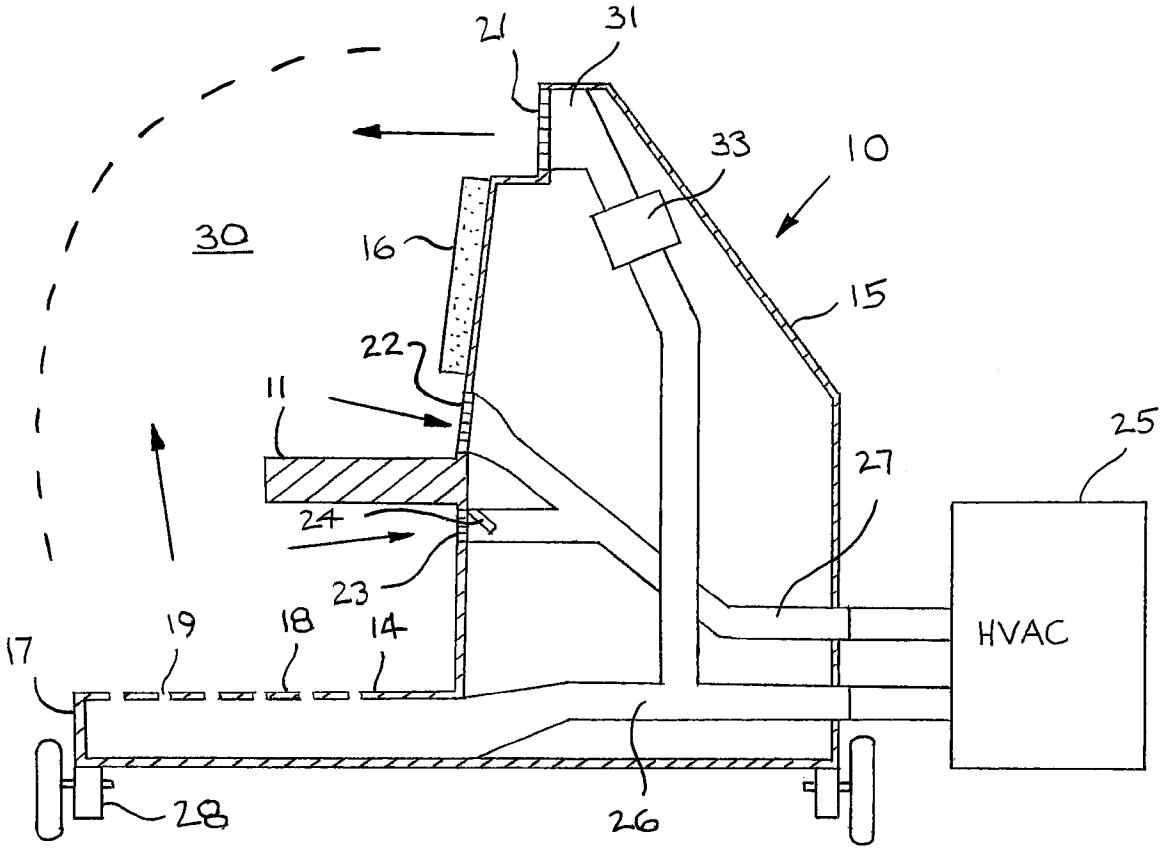
FIG. 2 is a cross sectional view of an embodiment of the seating system, showing the second air intake and the transportation means.

Referring to FIGS. 1 and 2, the outdoor heating and cooling seating system is generally comprises a movable or portable bench device 10 having a seat member 11, a seat back member 12, and a deck member 14, and a cabinet 15. The system comprises a first air outlet 20, a second air outlet 21, a first air intake 22, and a high volume air conditioning (HVAC) means 25 for conditioning air by producing heating or cooling temperature charge to air. The HVAC means 25 may be one or more units of any known type and may include condensers, chilled water devices, resistance heaters, gas heaters, blowers or like devices well known in the HVAC industry. In embodiments where the HVAC means 25 is placed at a distance from the seating system, the HVAC means 25 should be of sufficient capacity and power to be able to deliver the needed quantity of charged air over a significant distance, such that preferably the HVAC means 25 may be positioned a good distance from the athletic playing field, and preferably under the bleachers or fan seating areas if such are present. Alternatively, the HVAC means 25 could be portable, such that it may be brought near the bench device 10, then removed to storage when not in use. As another embodiment, the HVAC means 25 is a compact unit disposed inside the cabinet 15. For example, in this embodiment the HVAC means 25 is one or more water to air heat pumps disposed inside the cabinet 15, as described in more detail below.

In a general embodiment of the system, the seat back 12 generally has a back rest 16. The first air outlet 20 is positioned on the deck member 14, and the second air outlet 21 is disposed above the back rest 16. The first air intake 22 is generally located within the seat back 12. As a non-limiting example, the first air intake 22 is located in the seat back 12 between the back rest 16 and the seat member 11. The HVAC means 25 is connected to the first air outlet 20 and the second air outlet 21 by air delivery conduits 26, and the first air intake 22 is connected to the HVAC means by an air return conduit 27. The air delivery conduits 26 and the air return conduits 27 are enclosed within the cabinet 15, thereby forming a self contained bench device for ease of use and portability.

Figure 3:
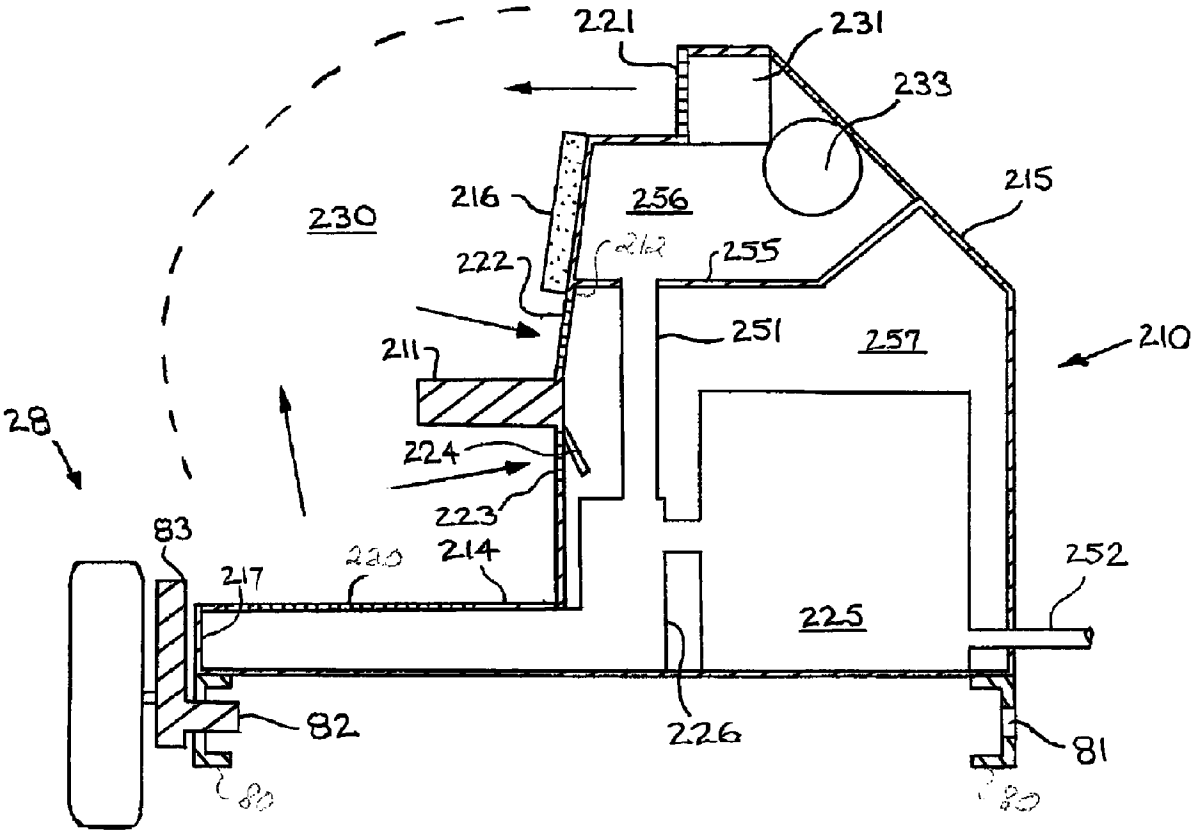
FIG. 3 is a cross sectional view of an embodiment of the seating system in which the HVAC means is disposed inside the cabinet.

In use, the basic embodiment of the seating system permits engagement of the HVAC means 25 to the air delivery conduits 26. The HVAC means 25 forces conditioned air through the air delivery conduits 26 to the first air outlet 20 and the second air outlet 21, where the conditioned air is expelled by the seating system to create a temperature-controlled zone 30 that extends approximately four to six feet above the deck member 14. The bold arrows in FIGS. 1-3 show the direction of air flow to and from the temperature-controlled zone 30. The users, such as athletes, can then enter the temperature-controlled zone 30 to raise or lower their body temperature. Once the user enters the zone 30, heat is exchanged between the user and the charged air, depleting the air's temperature charge. A first portion of air having a depleted charge is then retrieved from the temperature-controlled zone 30 via the first air intake 22 and passed through the air return conduit 27 and returned to the intake of the HVAC means 25. This first portion of air is then reconditioned by the HVAC means 25, re-delivered to the first air outlet 20 and the second air outlet 21 via the air delivery conduits 26 and reintroduced into the temperature-controlled zone 30. This return cycle of charged air via the first air intake 22 promotes efficiency of the HVAC means 25 because it reduces the temperature range for which the HVAC means 25 must charge its intake air to produce the desired level of conditioning for its output air.

In one embodiment of the seating system, the first air outlet 20 comprises vents 19 in an upper support surface 18 of the deck member 14. In this embodiment, the deck member 14 comprises a housing 17 with sides and a bottom that supports the upper support surface 18, thereby defining an open interior. The interior of the deck member 14 may be provided with baffles, plenums, sectional walls or other means to better distribute the air in an even manner. The upper support surface 18 is constructed of material such that multiple persons and one or more benches may be readily supported thereon. The first air outlet 20 takes the form of vents 19 disposed in the upper support surface 18 such that air delivered into the deck member 14 is emitted upwardly from the upper support surface 18. The vents 19 are sized sufficiently small such that shoe cleats cannot enter the vents 19. For example, the vents 19 could be holes in a plate member, along with other possible embodiments, such as a grating system or the like.

One embodiment of the second air outlet 21 comprises a housing 31 having a grate 32 positioned on the bench device 10 above the back rest 16 between the air delivery conduit 26 and the ambient air. In this embodiment, the second air outlet 21 runs along the full length of the bench device 10. The housing 31 is connected to the air delivery conduit 26, and the housing 31 can further comprise baffles, plenums, sectional walls or other means to better distribute the air in an even manner. As another exemplary option, the air delivery conduit 26 can comprise several conduits that connect along the length of the housing 31 at intervals to assist in even dispersement of conditioned air along the length of the bench device 10. In another embodiment, the second air outlet 21 further comprises one or more air control means 33 for controlling the flow of air through the air delivery conduit 26 that delivers conditioned air to the second air outlet 21. The air control means 33 can be one or more booster fans or dampers disposed upstream from the second air outlet 21 and manipulated to promote or inhibit the flow of air through the air delivery conduits 26 to the second air outlet 21.

In another embodiment, the seating system further comprises a second air intake 23 disposed in the bench device 10 below the seat member 11 and above the deck member 14, and operably connected to the air return conduits 27. The second air intake 23 further comprises a damper 24 that is manipulated to control the flow of air through the second air intake 23. For example, in some instances, the conditioned air expelled from the first air outlet 20 flows uninterrupted past the seat member 11 and into the temperature-controlled zone 30. In these instances the damper 24 remains closed, thereby sealing off the second air intake 23 from receiving air. In other circumstances, the air expelled from the first air outlet 20 becomes inadvertently trapped between the seat member 11 and the deck member 14. In this scenario, the damper 24 opens, thereby permitting the trapped conditioned air to reenter the system via the second air intake 23, whereby the air is returned to the HVAC means 25 via the return conduits 27. In this manner, the system promotes efficiency by ensuring that all of the conditioned air cycles through the temperature-conditioned zone 30.

In another embodiment, shown in FIG. 3, the HVAC means 225 is disposed inside the cabinet 15. The outdoor heating and cooling seating system of this embodiment generally comprises a first air outlet 220, a second air outlet 221, a first air intake 222, and one or more HVAC means 225 for conditioning air by producing heating or cooling temperature charge to air. The HVAC means 225 is a compact unit disposed inside the cabinet 215. For example, the HVAC means 225 could be one or more water to air heat pumps disposed inside the cabinet 215.

The first air outlet 220 is positioned on the deck member 214, and the second air outlet 221 is disposed above the back rest 216. The first air intake 222 is located in the seat back 212 between the back rest 216 and the seat member 211. The HVAC means 225 is connected to the first air outlet 220 and the second air outlet 221 by air delivery conduits 226, which take the form of a distribution box running along the longitudinal direction of the seating system inside the cabinet 215. The distribution box 226 is connected to the deck member 214 and emits high volume air via the first air outlet 220, which comprises grating panels that form the top side of the housing 217 in the deck member 214. The HVAC means 225 delivers air to the second air outlet 221 via supply conduits 251 intermittently spaced along the length of the distribution box 226. The supply conduits 251 are any duct, baffle, conduit, or other member capable of routing conditioned air from the distribution box 226 to the second air outlet 221.

In one embodiment, the system further comprises a housing 231 positioned above the back rest 216. In this embodiment, the second air outlet 221 runs along the full length of the bench device 210. The housing 231 can comprise baffles, plenums, sectional walls or other means to better distribute the output air in an even manner. The second air outlet 221 can further comprise one or more air control means 233, such as one or more booster fans, to further facilitate air flow from the distribution box 226 through the supply conduits 251, the housing 231, the second air outlet 221, and into the to the temperature-controlled zone 230. These booster fans can be installed along the length of the second air outlet 221 at any desired interval.

The first air inlet 222 draws a portion of partially conditioned air from the temperature-controlled zone 230 back into the cabinet 215 where the partially conditioned air then enters the HVAC means 225 and is reconditioned before being cycled back to the temperature-controlled zone 230 via the distribution box 226, the first air outlet 220, and the second air outlet 221. The intermittent spacing of the supply conduits 251 permits the return air to flow between the supply conduits 251 and back to the HVAC means 225. Thus, in this embodiment, there is no need for an air return conduit running directly from the first air intake 222 to the HVAC means 225. In most instances, the portion of intake air simply enters the cabinet 215 through the first air intake 222 and matriculates through the cabinet 225 to the HVAC means 225. The distribution box 226 and the HVAC means 225 are enclosed within the cabinet 215, thereby forming a self contained bench device for ease of use and portability. In this embodiment, the units for the HVAC means 225 are disposed in communication with one or more operation inputs and outputs 252, such as water lines for operation of water to gas heat pumps, or electrical power lines typically available at stadia and athletic facilities.

In one embodiment of the cabinet 215, the cabinet further comprises a dividing panel 255 that separates the interior of the cabinet into an upper compartment 256 and a return air plenum 257. The supply conduits 251 direct conditioned air to the upper compartment 256 where the conditioned air is expelled through the second air outlet 221, typically with the assistance of booster fans 233. The panel 255 allows the first air intake 222 to operate as a free draw air return, drawing air into the return plenum 257 where the air matriculates back into the HVAC means 225.

In use, the HVAC means 225 forces conditioned air through the distribution box 226 to the first air outlet 220, and through the supply conduits 251 to the second air outlet 221, where the conditioned air is expelled by the seating system to create the temperature-controlled zone 230. The users, such as athletes, can then enter the temperature-controlled zone 230 to raise or lower their body temperature, which depletes the temperature charge of the air, as described above. A first portion of air having a depleted charge is then retrieved from the temperature-controlled zone 230 via the first air intake 222 and passed through the interior of the cabinet 215 and returned to the intake of the HVAC means 225. This first portion of air is then reconditioned by the HVAC means 225 and once again delivered to the first air outlet 220 and the second air outlet 221 via the distribution box 226. This return cycle of partially charged air via the first air intake 222 promotes efficiency because it reduces the temperature range for which the HVAC means 225 must charge its intake air to produce the desired level of conditioning for its output air. This increase in efficiency allows the system to operate in a satisfactory manner by using HVAC means 225 of a smaller size, which decreases the footprint of the seating system. This space savings can be an important feature, such as on the crowded sidelines of a professional sports team.

In another embodiment, the seating system further comprises a second air intake 223 disposed in the bench device 210 below the seat member 211 and above the deck member 214. The second air intake 223 further comprises a damper 224 that is manipulated to control the flow of air through the second air intake 223, as described above. Notably, in this embodiment the second air intake 223 does not need to be connected to the HVAC means 225 by an air return conduit, although this could be the case, if desired. In most instances, there is no air return conduit. Instead, the second air intake 223 draws a portion of air from the temperature-controlled zone 230 into the cabinet 215, where this portion of air matriculates to the HVAC means 225 before being recharged and returned to the temperature-controlled zone 230.

In another embodiment of the seating system, shown in FIG. 3, the bench member 10 further comprises transportation means 28 for transporting the system, such as a motorized vehicle or wheeled trailer, such that the system can be taken to any outdoor location where a temperature-controlled zone 30 is desired. For example, the transportation means 28 could comprise a base frame 80 operably connected to the bottom of the bench member 10 and wheels operably connected to the base frame 80. In one embodiment, the transportation means 28 comprises a base frame 80 of structural members having a web, wherein the webs of the structural members comprise receiving holes 81 for receiving an insert member 82 of a wheel assembly. The wheel assembly comprises a jack 83 for raising or lowering the seating system via the base frame 80. Other portions of the base frame 80 can comprise additional receiving holes 81 for receiving an insert member 82 of a trailer hitch, swivel wheel, the arms of a forklift or other such devices used to maneuver the seating system.

For example, the seating system has a longitudinal direction along the length of the seat member 11, and a transverse direction across the seat member 11. The longitudinal members of the base frame 80 comprises receiving holes 81 for receiving the insert members 82 of a wheel assembly and other receiving holes 81 for receiving the arms of a forklift. The transverse member of the base frame 80 comprises a receiving hole 81 for receiving the insert member 82 of a trailer hitch. Thus, the seating system can be attached to the trailer hitch of a tractor or lifted by a forklift and placed on a flat bed truck for transport.

In another embodiment, the bench device 10 is fitted with a canopy attached to a frame extending from the top of the bench device 10. The canopy is configured to overhang the seat member 11 such that the canopy protects persons from precipitation or direct sunlight when the person is seated on the seat member 11.

In any of the foregoing embodiments, the seating system can further comprise a control means disposed on the exterior of the cabinet. The control means is any means for controlling operation of the heating, cooling, and operation of the seating system. For example, the control means could be a control panel having operation controls such as on/off, heating/cooling, auto, fan only, high/medium/low, and other modes of operation as desired. In addition, the cabinet in any embodiment can be fitted with any number or configuration of access panels to access the internal components of the seating system.

The foregoing embodiments are merely representative of the outdoor heating and cooling seating system and not meant for limitation of the invention. For example, one having ordinary skill in the art would understand that many components described herein can be customized for specific applications by an ordinary practitioner. Consequently, it is understood that equivalents and substitutions for certain elements and components set forth above are part of the invention, and therefore the true scope and definition of the invention is to be as set forth in the following claims.

We claim:

1. An outdoor heating and cooling seating system creating an open temperature-controlled zone for personnel, said system comprising: a bench device; an outwardly extending seat member disposed at a raised elevation on said bench device; an outwardly extending deck member disposed at a base of said bench device, said deck member comprising an upper support surface adapted to support personnel standing on said deck member; said deck member disposed below and extending farther outward than said seat member such that personnel may stand on said deck member or sit on said seat member; an air conditioning means for producing and delivering conditioned air through an air delivery conduit; a first air outlet disposed within said deck member, said first air outlet operably connected to said air delivery conduit whereby said conditioned air is expelled in an upward direction through said upper support surface around and past said seat member; a second air outlet disposed above said seat member, said second air outlet operably connected to said air delivery conduit whereby said conditioned air is expelled in a forward direction over said seat member; and a first air intake disposed between said first air outlet and said second air outlet said first air intake configured to retrieve and return a first portion of said conditioned air expelled from said first air outlet and said second air outlet to said air conditioning means such that said first portion of said conditioned air is reconditioned by said air conditioning means, re-delivered through said air delivery conduit and expelled through said first and second air outlets.

2. The seating system of claim 1, said bench device further comprising a cabinet, wherein said seat member is disposed at a raised elevation on and extends outward from said cabinet and said deck member is disposed at a base of said cabinet and extends outward from said cabinet, and wherein the air conditioning means comprises one or more units disposed inside said cabinet.

3. The seating system of claim 2, further comprising a booster fan disposed upstream from the second air outlet.

4. The seating system of claim 3, said bench device further comprising a seat back member and a back rest, and wherein said first air intake is disposed in the seat back member at a location between said back rest and said seat member.

5. The seating system of claim 1, said bench device further comprising a cabinet, wherein said seat member is disposed at a raised elevation on and extends outward from said cabinet and said deck member is disposed at a base of said cabinet and extends outward from said cabinet, and wherein the air conditioning means comprises one or more units disposed outside said cabinet.

6. The seating system of claim 5, further comprising a booster fan disposed upstream from the second air outlet.

7. The seating system of claim 6, said bench device further comprising a seat back member and a back rest, and wherein said first air intake is disposed in the seat back member at a location between said back rest and said seat member.

8. The seating system of claim 1, wherein said first air intake is disposed at a location above the seat member, and further comprising a second air intake disposed within the bench device at a location below the seat member and above the deck member, said second air intake configured to return a second portion of said conditioned air expelled from said first air outlet and said second air outlet to said air conditioning means, such that said second portion of said conditioned air is reconditioned by said air conditioning means, re-delivered through said air delivery conduit and expelled through said first and second air outlets.

9. The seating system of claim 8, said bench device further comprising a cabinet, and wherein the air conditioning means comprises one or more units disposed inside said cabinet.

10. The seating system of claim 9, further comprising a booster fan disposed upstream from the second air outlet.

11. The seating system of claim 10, said bench device further comprising a seat back member and a back rest, and wherein said first air intake is disposed in the seat back member at a location between said back rest and said seat member.

12. The seating system of claim 8, said bench device further comprising a cabinet, and wherein the air conditioning means comprises one or more units disposed outside said cabinet.

13. The seating system of claim 12, further comprising booster fan disposed upstream from the second air outlet.

14. The seating system of claim 13, said bench device further comprising a seat back member and a back rest, and wherein said first air intake is disposed in the seat back member at a location between said back rest and said seat member.

15. A method of heating and cooling an unbounded temperature-controlled zone for personnel comprising the steps of: providing a heating and cooling system comprising a bench device; an outwardly extending seat member disposed at a raised elevation on said bench device; an outwardly extending deck member disposed at a base of said bench device, said deck member comprising an upper support surface adapted to support personnel standing on said deck member; said deck member disposed below and extending farther outward than said seat member such that personnel may stand on said deck member or sit on said seat member; an air conditioning means for producing and delivering conditioned air through an air delivery conduit; a first air outlet disposed within said deck member, said first air outlet operably connected to said air delivery conduit whereby said conditioned air is expelled in an upward direction through said upper support surface around and past said seat member; a second air outlet disposed above said seat member, said second air outlet operably connected to said air delivery conduit whereby said conditioned air is expelled in a forward direction over said seat member; and a first air intake disposed between said first air outlet and said second air outlet; said first air intake configured to retrieve and return a first portion of said conditioned air expelled from said first air outlet and said second air outlet to said air conditioning means; producing and delivering conditioned air through said air delivery conduit to said first and second air outlets; expelling said conditioned air through said first and second air outlets; retrieving a first portion of said conditioned air through said first air intake; returning said first portion of said conditioned air to said air conditioning means; and reconditioning said first portion of said conditioned air retrieved through said first air intake, delivering said reconditioned first portion of said conditioned air through said air delivery conduit and expelling said reconditioned first portion of said conditioned air through said first and second air outlets.

16. The method of claim 15, further comprising the steps of: providing said heating and cooling system with a second air intake disposed within the bench device at a location below the seat member and above the deck member, said second air intake configured to retrieve and return a second portion of said conditioned air expelled from said first air outlet and said second air outlet to said air conditioning means, retrieving the second portion of said conditioned air through said second air intake from below said seat member; returning said second portion of said conditioned air to said air conditioning means; and reconditioning said second portion of said conditioned air retrieved through said second air intake, delivering said reconditioned second portion of said conditioned air through said air delivery conduit and expelling said reconditioned second portion of said conditioned air through said first and second air outlets.

17. The method of claim 15, further comprising the steps of: providing said heating and cooling system with a second air intake disposed within the bench device at a location below the seat member and above the deck member, said second air intake configured to retrieve and return a second portion of said conditioned air expelled from said first air outlet and said second air outlet to said air conditioning means; retrieving the second portion of said conditioned air through said second air intake from below said seat member; returning said second portion of said conditioned air to said air conditioning means; and reconditioning said second portion of said conditioned air retrieved through said second air intake, delivering said reconditioned second portion of said conditioned air through said air delivery conduit and expelling said reconditioned second portion of said conditioned air through said first and second air outlets.

* * * * *